US008080927B2

(12) United States Patent
Boy et al.

(10) Patent No.: US 8,080,927 B2
(45) Date of Patent: Dec. 20, 2011

(54) DEVICE AND MODULE FOR PROTECTING AGAINST LIGHTNING AND OVERVOLTAGES

(75) Inventors: Juergen Boy, Berlin (DE); Gero Zimmermann, Berlin (DE); Thomas Westebbe, Berlin (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 12/643,155

(22) Filed: Dec. 21, 2009

(65) Prior Publication Data

US 2010/0156264 A1 Jun. 24, 2010

Related U.S. Application Data

(63) Continuation of application No. PCT/EP2008/057914, filed on Jun. 20, 2008.

(30) Foreign Application Priority Data

Jun. 21, 2007 (DE) ..... 10 2007 029 093

(51) Int. Cl.
*H01T 4/12* (2006.01)
*H01T 4/16* (2006.01)

(52) U.S. Cl. ..... 313/231.01; 313/601; 313/326; 361/120

(58) Field of Classification Search ..... None
See application file for complete search history.

(56) References Cited

U.S. PATENT DOCUMENTS

| | | | | | |
|---|---|---|---|---|---|
| 3,376,458 | A * | 4/1968 | Liao | 313/325 |
| 3,878,423 | A * | 4/1975 | Hill et al. | 313/267 |
| 4,104,693 | A * | 8/1978 | Toda et al. | 361/120 |
| 4,123,682 | A * | 10/1978 | Lange et al. | 313/54 |
| 5,450,273 | A * | 9/1995 | Boy | 361/129 |
| 5,557,250 | A * | 9/1996 | Debbaut et al. | 338/21 |
| 5,657,196 | A * | 8/1997 | Chaudhry et al. | 361/117 |
| 5,724,220 | A * | 3/1998 | Chaudhry | 361/119 |
| 6,326,724 | B1 * | 12/2001 | Daumer et al. | 313/484 |
| 6,952,336 | B2 * | 10/2005 | Werner et al. | 361/119 |
| 7,411,291 | B2 * | 8/2008 | Baier et al. | 257/723 |

FOREIGN PATENT DOCUMENTS

| | | |
|---|---|---|
| CH | 345061 | 3/1960 |
| DE | 298 10 937 U1 | 11/1999 |
| EP | 1 353 422 A1 | 10/2003 |
| FR | 1 105 065 | 11/1955 |
| JP | 2006-24423 A | 1/2006 |

* cited by examiner

*Primary Examiner* — Ashok Patel
(74) *Attorney, Agent, or Firm* — Slater & Matsil, L.L.P.

(57) ABSTRACT

A device for protecting against lightning and overvoltages includes two electrodes closing off, in a gas tight manner, both end faces of a cylinder made of insulating material, and defining a discharge chamber in the interior of the chamber thus formed. At least one step is provided in the chamber in the contact area of at least one of the electrodes and the cylinder such that the chamber extends outwards past the internal wall of the cylinder.

25 Claims, 7 Drawing Sheets

DEVICE AND MODULE FOR PROTECTING AGAINST LIGHTNING AND OVERVOLTAGES

This application is a continuation of co-pending International Application No. PCT/EP2008/057914, filed Jun. 20, 2008, which designated the United States and was not published in English, and which claims priority to German Application No. 10 2007 029 093.6 filed Jun. 21, 2007, both of which applications are incorporated herein by reference.

TECHNICAL FIELD

Embodiments of the invention relate to a device for protecting against lightning and overvoltages.

BACKGROUND

Protection devices are provided as, among others, lightning and/or overvoltage protection in the primary power system of physical structures, wherein the external conductors are each connected to the neutral conductor by means of a lightning surge arrestor. Such a device is also known as a discharge arrangement or surge arrestor arrangement.

An arrestor serves to prevent hazards to life, system and device damage, and fire. The task of the lightning and overvoltage protection is the reduction of overvoltages to a protection level of 1.5 kV, and arresting strong current surges up to 50 kA. Explosive flames and shock waves must be avoided in order to enable installation in typical equipment without observing special safety clearances and passive fire prevention measures. The extinguishing capabilities and the limiting of the power frequency follow current must be designed so that service line main fuses are not triggered. Finally, compatibility with standardized assembly systems and ruggedness with respect to climate influences and pollution are required.

Typical characteristic data of such lightning and overvoltage protection devices are: a D.C. spark-over voltage of Vsdc>600 V, a surge spark-over voltage vas≦1.5 kV for a voltage increase rate of 5 kV/μs, a nominal surge current iSN of 50 kA for standardized surge current curves of 8/20 μs and 10/350 μs and, in each case, 15 times load factor, and a power frequency follow current of ≦50 kA.

When a surge arrestor is triggered, an arc is generated that creates combustion products, which can precipitate as a conductive vaporization on the interior cylinder of the ceramic or insulating material and cause a fault in the insulation.

For fulfilling the protection function, a low dynamic spark-over voltage is required. For the entire component the required value is 1500 V, if a ramp-shaped voltage increasing at a rate of 5 kV/μs is applied. For a single arrestor, this level of protection and the remaining characteristic data imply that an ignition aid must be used. One way to improve the ignition behavior is the introduction of an ignition strip made of graphite, for example, which makes primary charge carriers available, biases the electrical field, and improves the dynamic ignition behavior by means of a creeping discharge along the ceramic surface of the inner wall of the cylinder.

SUMMARY

In one aspect, the invention provides a device with which a desired characteristic data can be attained or exceeded.

A device for protecting against lightning and overvoltages provides two electrodes closing off in a gas tight manner both end faces of a cylinder, made of insulating material, particularly aluminum oxide ceramic, and defining a discharge chamber in the interior of the chamber thus formed. Within the chamber, a step is provided in the contact area of at least one of the electrodes and of the cylinder such that the chamber extends beyond the inner wall of the cylinder.

The electrodes are preferably composed of copper or copper alloys. The chamber is the entire gas-filled interior resulting after soldering or sealing the cylinder to the electrodes. The discharge chamber is basically the chamber region; however, a high energy discharge for protection against lightning and overvoltages takes place in a discharge path formed between electrode surfaces facing each other at a close distance, particularly in the central region of the device. The region of the face side of the cylinder, at which in principle the cylinder can be connected or soldered to the electrodes, is designated as the contact region. Thus, the contact region extends at least over the thickness of the inner wall of the cylinder.

Due to the step, the insulation distance to the respective electrode is lengthened at least by the length and height of the step. A high insulation level of the device, or of the arrestor, is thereby attained during the entire service life, even with repeated impulse or follow current discharges.

It is provided that the step is disposed in the face side inner wall of the cylinder. Alternatively, or in addition, the step is disposed in at least one of the electrodes.

Ignition aids, particularly ignition strips made of graphite, that are applied on the inner wall of the cylinder, and that extend in one embodiment up to the face side inner wall of the cylinder, improve the ignition behavior and the discharge ability of the device or the arrester. The ignition aid improves the dynamic ignition behavior of the arrestor, in that it particularly provides, primary charge carriers, biases the electric field, and improves a creeping discharge along the surface of the ceramic cylinder.

As an alternative or supplement to ignition aids, it is provided that the electrodes are coated with an activation mass, which also improves the ignition behavior.

The ignition properties of the device can be improved further if the ignition aids extend on the inner wall of the cylinder up to the step in the face side inner wall of the cylinder. The distance from the end of the ignition strips to the metal electrode (residual insulation) can thereby be adjusted, and kept so small that the function of the ignition strip is optimized. It is particularly provided in one embodiment that the ignition aids are widened in the transition region from the inner wall to the face side inner wall of the cylinder.

Further variations of the geometry of the ignition strip are provided so that they further improve the dynamic ignition behavior of the arrestor.

In one embodiment, the ignition strips thus formed are distributed over the inner circumference of the cylinder at intervals of 45°.

The device is designed for stacking, so that a plurality of similarly constructed devices can be stacked. Modules having a plurality of individually exchangeable devices that can have different spark-over voltages can thereby be constructed in a simple manner.

In one embodiment, at least one of the electrodes has a cup-shaped region and a bead-shaped region extending in the longitudinal direction of the device on each side of the plane of the contact area of the cylinder and the electrode. This enables particularly efficient stacking because the center electrode of two arrestors must be present only once, although it is available to both arrestors as an electrode.

In one embodiment, the arrestor is built so that the electrodes are mirrored about the transverse axis of the device. This enables efficient stacking with small dimensions of the module built in this manner.

In a module, multiple devices or arrestors are connected in series. It is particularly space saving when two series-connected devices have a common center electrode that is built as one of the two electrodes of each of the two devices.

The properties of a module including series connected arrestors can be optimized when a varistor is connected in parallel to at least a section of the series connected devices. A plurality of varistors can also be connected in parallel to combinations of arrestors, as required.

In one embodiment of the module, a plurality of arrestors having different spark-over voltages is connected in series.

The use of one or a plurality of arrestors with a hermetically sealed, gas-filled housing enables the prevention of explosive flames and shock waves.

A series connection of a plurality of arrestors with different characteristics in one module makes it possible to control the required DC spark-over voltage, the surge spark-over voltage, and the power frequency follow current. Additionally connecting a varistor arranged in parallel to a plurality of series connected elements improves the behavior when loaded at the required DC spark-over voltage and the surge spark-over voltage. The high arc voltage of the individual arrestors limits the power frequency follow current.

Due to the high thermal capacity of the arrangement, particularly with the use of copper electrodes, and the good thermal conductivity of the filling gas, the arc is efficiently cooled, and the extinguishing behavior is improved.

In one practical embodiment, a module includes a retaining device having two electrically conducting retainers arranged on both sides of the module and connected by standoff isolators, and that clamp the module. The potential low construction height of an arrestor, and also of a series connection of arrestors in a module that is clamped between contact elements, as needed, simplifies the mounting of the device.

The design of an arrestor and the potential for a modular design of multiple arrestors allow optimization of the device. The use and the geometry of ignition strips support the defined spark-over of the device.

The combination of arrestors with varistors improves the protection of the system to be protected.

The subject described above is explained in more detail in the following, based on the figures and exemplary embodiments.

BRIEF DESCRIPTION OF THE DRAWINGS

The following described drawings are not to be viewed as true to scale. Rather, individual dimensions are enlarged, reduced, or even distorted for improved representation. Elements that are the same, or that take on the same functions, are labeled with the same reference numbers.

DETAILED DESCRIPTION OF ILLUSTRATIVE EMBODIMENTS

Figure 1A:
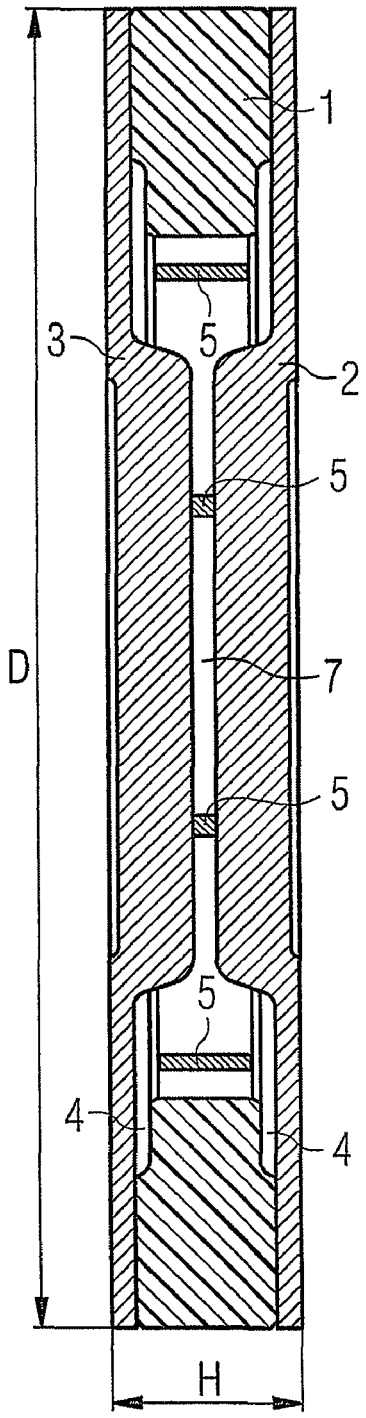
FIG. 1*a* shows an arrestor having a step in the cylinder made of insulating material.

An arrestor according to FIG. 1*a* contains a housing formed from a cylinder 1 made of an insulating material, e.g., a ceramic made of $Al_2O_3$, and two electrodes 2, 3, particularly having advantageous flow characteristics and high thermal conductivity, e.g. made of copper. The electrodes are particularly symmetrical. The discharge chamber is located in the interior of the chamber 7 formed by the housing. Due to a step 4 in the ceramic, a sufficiently high level of insulation of the arrestor is guaranteed over its entire service life, even in the case of repeated impulse and follow current discharges. The step elongates the wall side insulation distance between the electrodes.

Figure 1B:
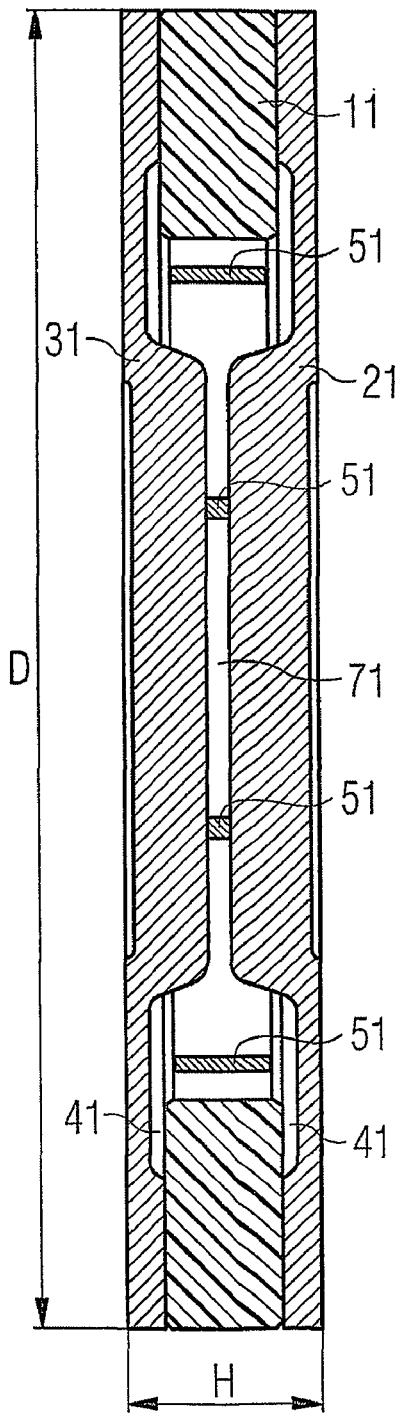
FIG. 1*b* shows an arrestor having a step in each of the two electrodes.

According to FIG. 1*b*, a different exemplary embodiment of an arrestor contains a housing formed from a cylinder 11 made of an insulating material, e.g., a ceramic made of Al2O3, and two electrodes 21, 31, particularly having advantageous flow characteristics and high thermal conductivity, e.g., made of copper. The electrodes are particularly symmetrical. The discharge chamber is located in the interior of the chamber 71 formed by the housing. Due to a step 41 in the electrodes in each case, a sufficiently high level of insulation of the arrestor is guaranteed over its entire service life, even in the case of repeated impulse and follow current discharges. The step 41 elongates the wall side insulation distance between the electrodes.

According to FIGS. 1*a* and 1*b*, an arrestor has an outer diameter D of, e.g., 30 mm, and a height H of, e.g., 3 or 4 mm.

Figure 1C:
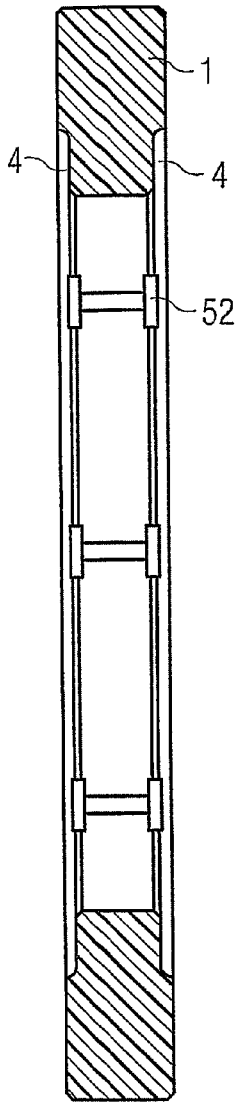
FIG. 1*c* shows an insulating cylinder having a step and ignition strips on the inner wall and the step.
Figure 1D:
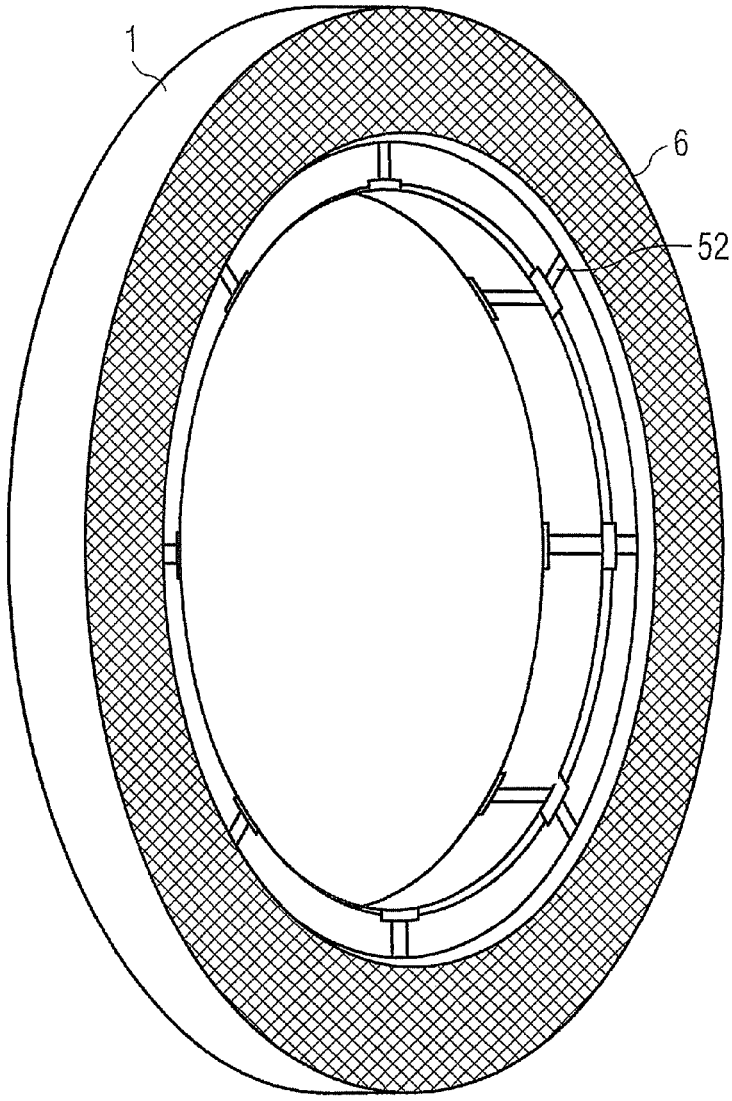
FIG. 1*d* shows the cylinder according to FIG. 1*c* in a perspective representation.
Figure 1E:
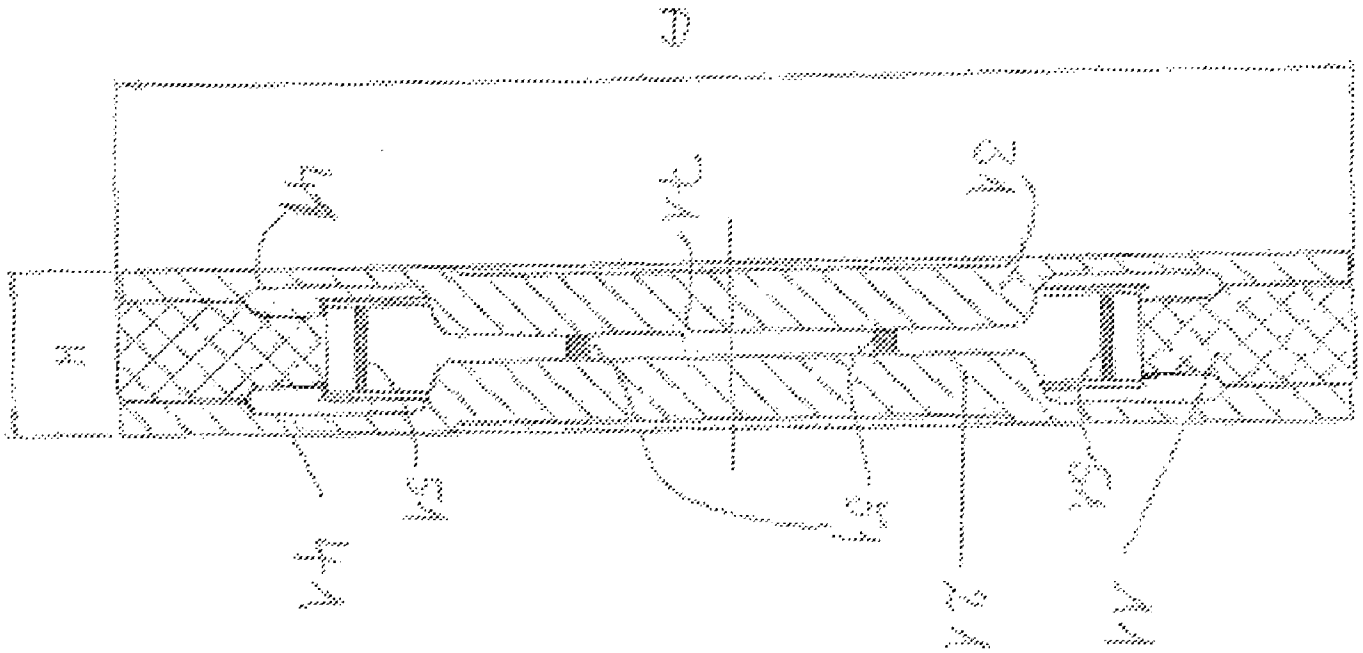
FIG. 1*e* shows an arrestor having a step in the cylinder and in each of the two electrodes.

FIG. 1*e* shows an embodiment where the step 4 is arranged in at least one of the electrodes and also in an inner wall of the cylinder.

The step 4 in the ceramic, or 41 in the electrode, prevents a continuous metallization layer during an arc discharge in the arrestor, and with it insulation problems of the arrestor, which can lead to a reduction in function, or render it unusable.

By using ignition strips 5 or 51 on the inner surface of the housing, and pasting the electrodes with an activation mass, the ignition behavior and the loading capacity of the arrestor can be further optimized.

The distance from the ignition strip 5, 51 to the metal electrodes of the arrestor is important for the function of the device and of the ignition strip of each arrestor. In an embodiment according to FIG. 1*a*, preferably a shaping of the ignition strip 5 up into the step 4 in the ceramic, it is advantageous, because it improves the connection of the ignition strips. The path from the end of the ignition strip to the electrodes can be optimized in this manner.

FIG. 1*c* shows the ignition strips 52 on the inner wall of the cylinder, and the step 4 in detail, and in FIG. 1*d* shows the same in perspective. The ignition strips widen in the edge region between the inner wall of the cylinder and the step 4. Naturally, other ignition strip geometries are provided. A metallization 6 is applied on a part of the face side of the cylinder for closure soldering to one of the electrodes.

After closure soldering, during which advantageously a gas mixture of high thermal conductivity and dielectric strength that is easily adjustable dependent on pressure, e.g., Ar/H2/Ne mixture, is used, a hermetically sealed, gas-filled arrestor having defined adjusted static and dynamic ignition properties and a high arc voltage is the result.

In order to attain protection from higher voltages and lightning, a plurality of arrestors constructed according to FIG. 1*a* or FIG. 1*b* are preferably connected in series, and formed into a module. To optimize the construction volume and the manufacturing process, further exemplary embodiments according to FIG. 2 or FIG. 3 are provided, in which the insulating ceramics 12, 14, 16, and 18 are stepped with respect to the electrodes 22, 32, or electrodes 23*a*, 23*b* are stepped with respect to the insulating ceramics 13, 15 and 17.

Figure 2:
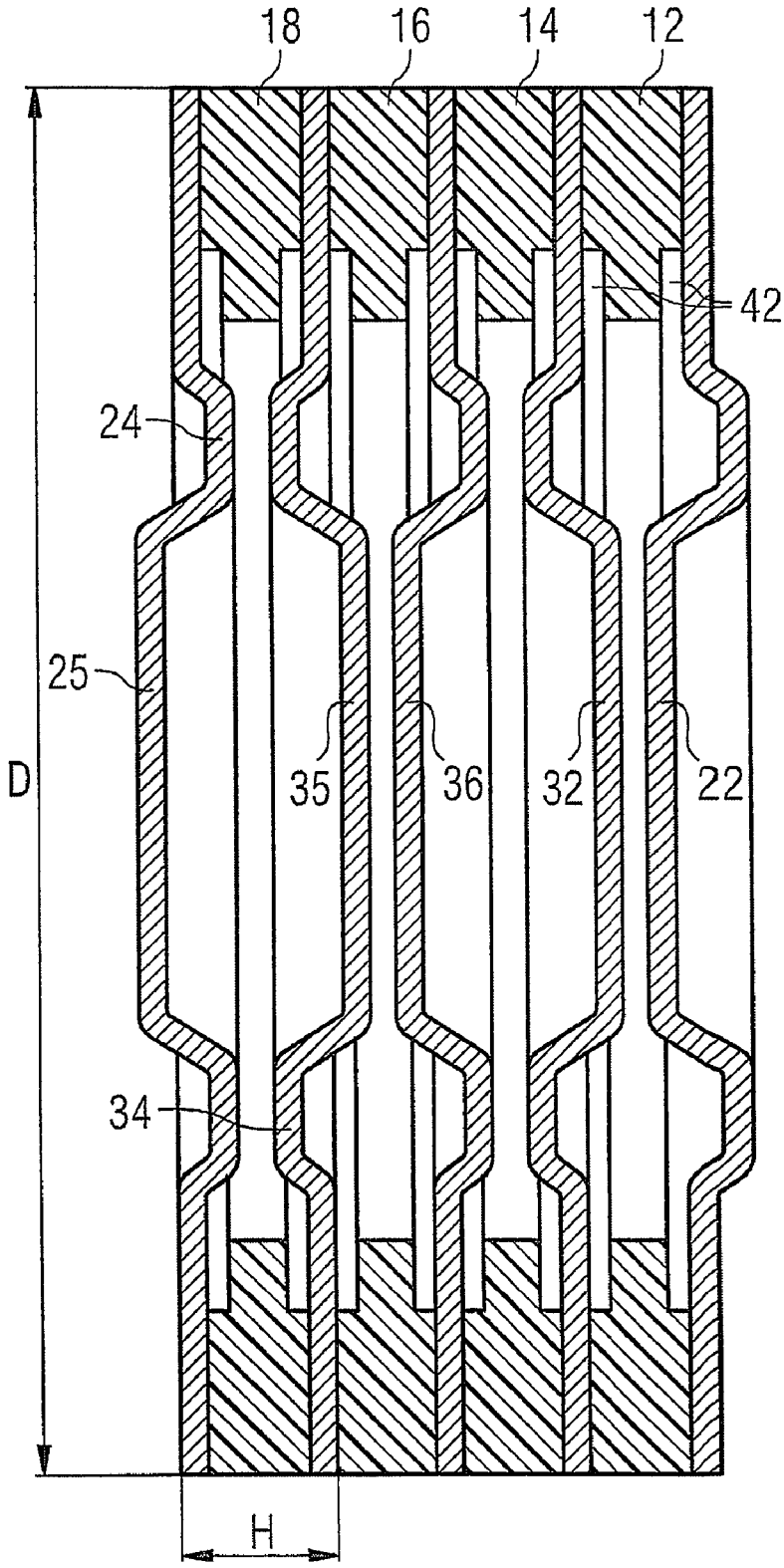
FIG. 2 shows a first module having a series connection of stacked arrestors.
Figure 3:
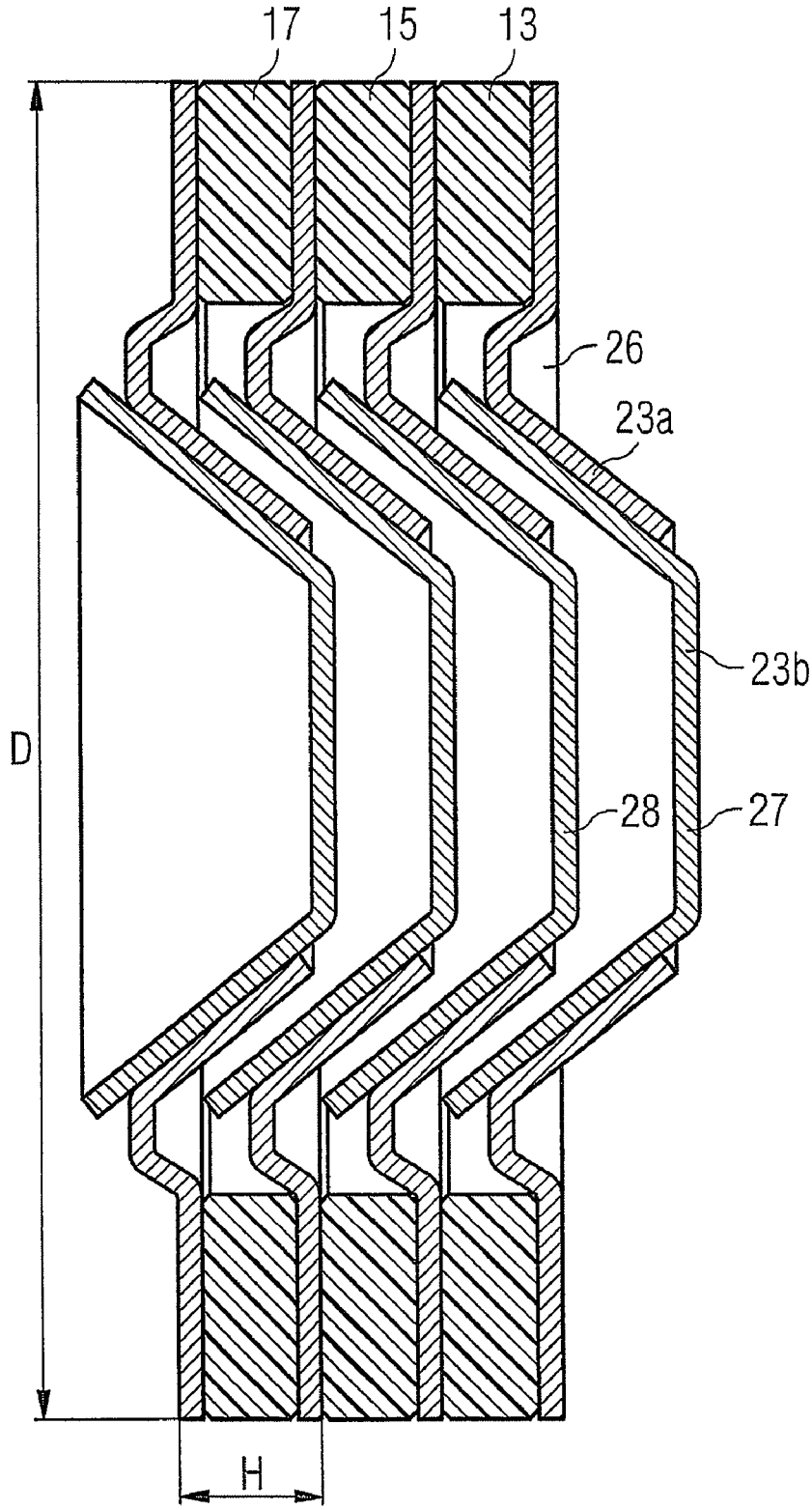
FIG. 3 shows a second module having a series connection of stacked arrestors.

According to FIG. 2 and FIG. 3, at least one of the electrodes has a cup-shaped region 25, 35 or 27, 28, and a bead-shaped region 24, 34 or 26, that each extend in the longitudinal direction of the device on both sides of the plane of the contact area of the cylinder and the electrode. This enables particularly efficient stacking because the center electrode 25 or 28 of two arrestors must be present only once, although it is available to both associated arrestors as an electrode.

The arrestors are constructed so that the electrodes are mirrored about the transverse axis of the device. This enables efficient stacking with small dimensions of the module built in this way.

In the modules according to FIG. 2 or FIG. 3, a plurality of devices or arrestors is connected in series. It is particularly space saving when two series-connected devices have a common center electrode built as one of the two electrodes of each of the two devices.

According to FIG. 4, the entire arrangement is composed of a series connection of individual arrestors FS200 and FS600 having the same (FS200) or different properties, e.g., having DC spark-over voltages of 200 V or 600 V. External wiring of different partial sections is advantageous. The wiring occurs preferably with varistors V1, V2, V3. However, it can also be realized in another manner with the goal of attaining a rapid increase in the potential at one or more individual arrestors in the case of dynamic loading.

Figure 4A:
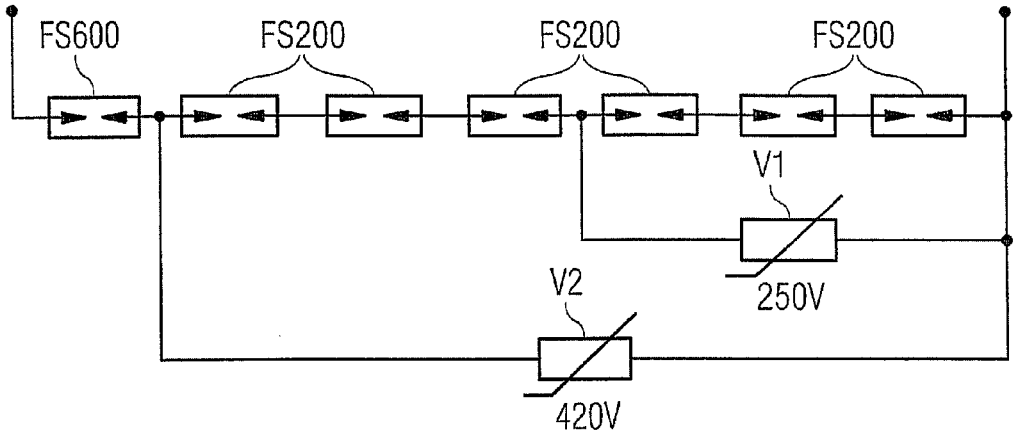
FIG. 4*a* to 4*c* shows equivalent circuit diagrams of modules having varistors that are in parallel to arrestors.
Figure 4B:
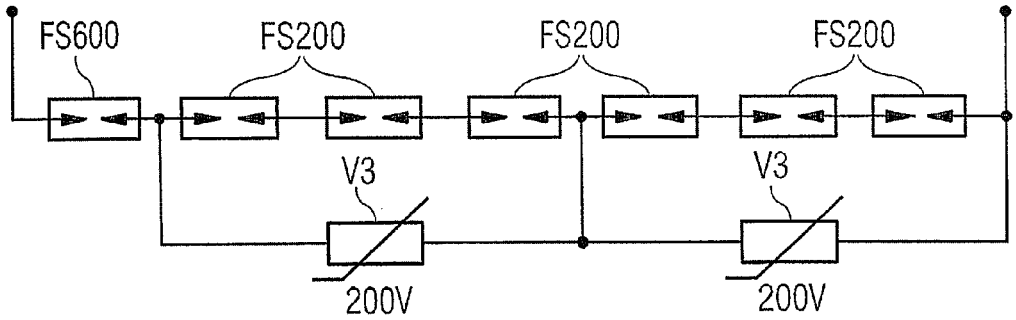
Figure 4C:
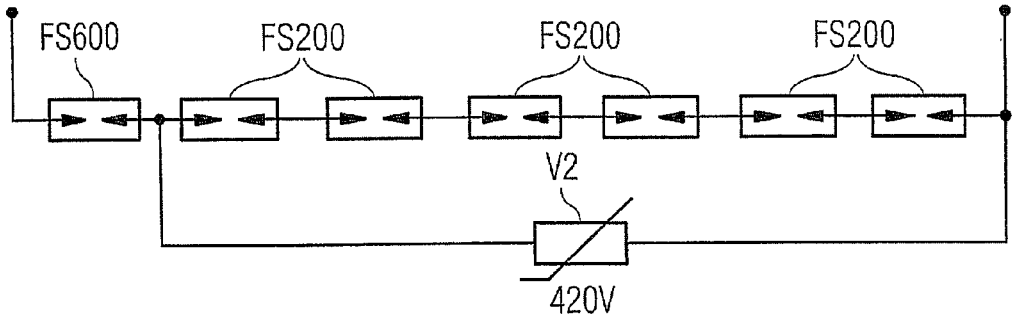

FIG. 4*a* shows a preferred embodiment comprising the six elements FS200 having vas=200 V and one element FS600 having vas=600 V, in combination with two varistors V1 having 250 V and V2 having 420 V. FIG. 4*b* shows the same arrestor arrangement as in FIG. 4*a*, however, having two varistors V3 each having 200 V, each being connected in parallel to three series connected arrestors FS200, and in series to each other. FIG. 4*c* shows the same arrestor arrangement as FIG. 4*a*, however, having a varistor V2 having 420 V connected in parallel to the six arrestors FS200.

Figure 5:
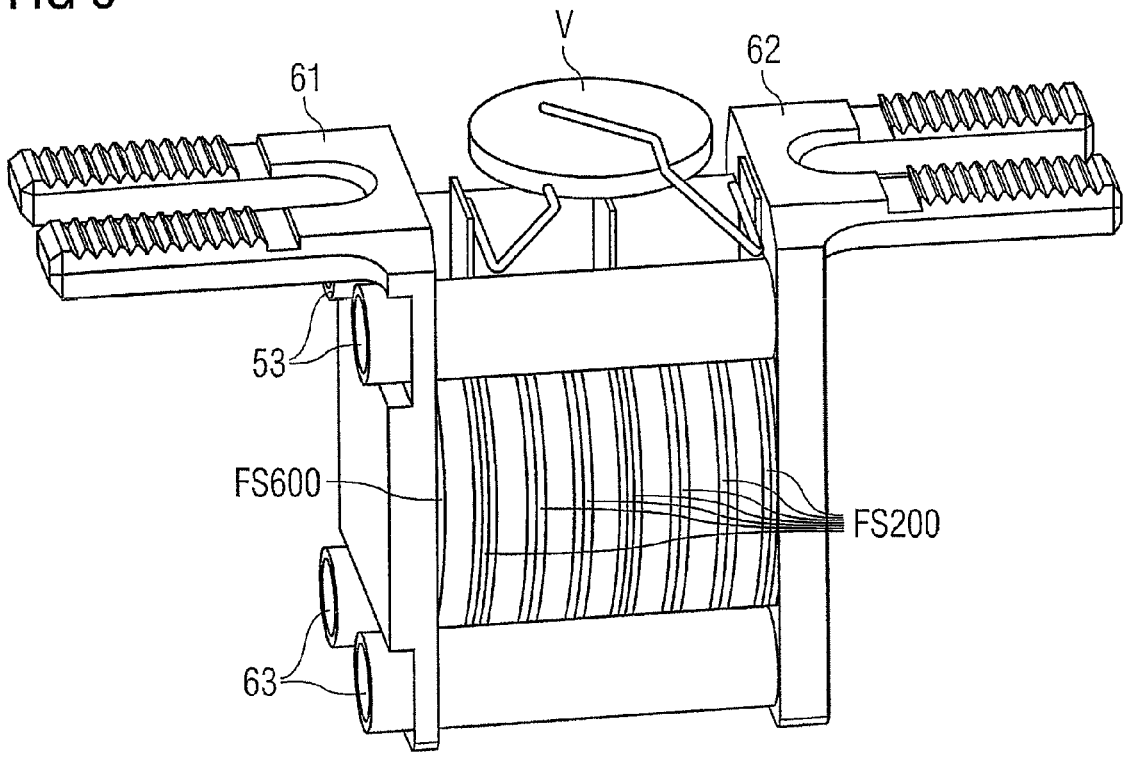
FIG. 5 shows a third module having a varistor in a clamp mounting.

FIG. 5 shows the series connection of individual arrestors FS200 and FS600 preferably realized by clamping in an electrically conducting clamp shaped retainer 61, 62, 63, considering ease of installation in a standardized bus bar system. A varistor V is connected in parallel to the arrestors FS200.

Clamping enables the simple adaptation of the electrical properties to the application, wherein individual arrestors can be varied or exchanged, and external wiring of different partial sections can be performed. This wiring occurs preferably with varistors, but it can be also realized in another manner with the goal of attaining a rapid increase in the potential at one or more individual arrestors in the case of dynamic loading.

What is claimed is:

1. A device for protecting against lightning and overvoltages, the device comprising:

a cylinder made of insulating material; and two electrodes closing off, in a gas tight manner, end faces of the cylinder thereby defining a discharge chamber;

wherein the chamber includes a step in a contact area between at least one of the electrodes and the cylinder, such that the chamber extends beyond an internal wall of the cylinder; and wherein an inner wall of the cylinder has ignition aids extending up to a face side inner wall of the cylinder.

2. The device according to claim 1, wherein the step is arranged in an inner wall of the cylinder.

3. The device according to claim 1, wherein the step is arranged in at least one of the electrodes.

4. The device according to claim 1, wherein the ignition aids are strip-shaped and extend up to the step in the face side inner wall of the cylinder.

5. The device according to claim 1, wherein the ignition aids are widened in a transition region from the inner wall to the face side inner wall of the cylinder.

6. The device according to the claim 1, wherein the two electrodes are mirrored about a transverse axis of the device.

7. A device for protecting against lightning and overvoltages, the device comprising:

a cylinder made of insulating material; and two electrodes closing off, in a gas tight manner, end faces of the cylinder thereby defining a discharge chamber;

wherein the chamber includes a step in a contact area between at least one of the electrodes and the cylinder, such that the chamber extends beyond an internal wall of the cylinder; and wherein the step is arranged in at least one of the electrodes and also in an inner wall of the cylinder.

8. A device for protecting against lightning and overvoltages, the device comprising:

a cylinder made of insulating material; and two electrodes closing off, in a gas tight manner, end faces of the cylinder thereby defining a discharge chamber;

wherein the chamber includes a step in a contact area between at least one of the electrodes and the cylinder, such that the chamber extends beyond an internal wall of the cylinder; and wherein the device is stackable for stacking a plurality of similar devices.

9. The device according to claim 8, wherein an inner wall of the cylinder has ignition aids extending up to a face side inner wall of the cylinder.

10. The device according to claim 9, wherein the ignition aids are strip-shaped and extend up to the step in the face side inner wall of the cylinder.

11. The device according to claim 9, wherein the ignition aids are widened in a transition region from the inner wall to the face side inner wall of the cylinder.

12. The device according to claim 8, wherein at least one of the electrodes has a cup-shaped region and a bead-shaped region extending in a longitudinal direction of the device on both sides of the plane of the contact area of the cylinder and the electrode.

13. The device according to claim 8, wherein the step is arranged in an inner wall of the cylinder.

14. The device according to claim 8, wherein the step is arranged in at least one of the electrodes.

15. The device according to claim 8, wherein the step is arranged in both an inner wall of the cylinder and at least one of the electrodes.

16. A module, comprising a plurality of series connected devices, each device comprising:

a cylinder made of insulating material; and two electrodes closing off, in a gas tight manner, end faces of the cylinder thereby defining a discharge chamber;

wherein the chamber includes a step in a contact area between at least one of the electrodes and the cylinder, such that the chamber extends beyond an internal wall of the cylinder.

17. The module according to claim 16, wherein each device further comprises ignition aids extending up to a face side inner wall of the cylinder.

18. The module according to claim 17, wherein the ignition aids are strip-shaped and extend up to the step in the face side inner wall of the cylinder.

19. The module according to claim 17, wherein the ignition aids are widened in a transition region from the inner wall to the face side inner wall of the cylinder.

20. The module according to the claim 16, wherein, for each device, the two electrodes are mirrored about a transverse axis of the device.

21. The module according to claim 16, wherein the series connected devices comprise two devices having a common center electrode built as one of the two electrodes of each of the two devices.

22. The module according to claim 16, further comprising a retaining device having two electrically conducting retainers arranged on two sides of the module, the retainers being connected by standoff isolators and clamping the module.

23. The module according to claim 16, further comprising a varistor coupled in parallel to at least a section of the series connected devices.

24. The module according to claim 16, wherein a plurality of devices having different spark-over voltages are connected in series.

25. The module according to claim 16, wherein, for each device, the step is arranged in an inner wall of the cylinder and/or in at least one of the electrodes.

* * * * *